US007331141B2

(12) United States Patent
Gilchrist

(10) Patent No.: US 7,331,141 B2
(45) Date of Patent: Feb. 19, 2008

(54) AUTOMATIC DOOR CONTROL APPARATUS

(75) Inventor: Jimmy Don Gilchrist, Ben Wheeler, TX (US)

(73) Assignee: Door Control Services, Inc., Ben Wheeler, TX (US)

( * ) Notice: Subject to any disclaimer, the term of this patent is extended or adjusted under 35 U.S.C. 154(b) by 463 days.

(21) Appl. No.: 10/867,243

(22) Filed: Jun. 14, 2004

(65) Prior Publication Data

US 2005/0274078 A1 Dec. 15, 2005

(51) Int. Cl.
*E05F 17/00* (2006.01)

(52) U.S. Cl. ..... 49/123; 49/116

(58) Field of Classification Search ..... 49/116, 49/118, 123, 360
See application file for complete search history.

(56) References Cited

U.S. PATENT DOCUMENTS 3,172,561 A * 3/1965 Schwartz ..... 220/709
4,050,191 A * 9/1977 Azuma ..... 49/360
4,149,615 A * 4/1979 Kappenhagen ..... 187/324
4,475,312 A * 10/1984 Deutschle ..... 49/360
4,503,637 A * 3/1985 Parente ..... 49/141
5,247,763 A * 9/1993 Hein ..... 49/31
5,422,552 A * 6/1995 Parisi ..... 318/466
5,755,060 A * 5/1998 Zweili ..... 49/449
5,797,471 A * 8/1998 Princell ..... 187/324
5,878,846 A * 3/1999 O'Donnell ..... 187/318
6,490,832 B1 * 12/2002 Fischbach et al. ..... 52/207
6,513,628 B2 * 2/2003 Mollenauer et al. ..... 187/324

* cited by examiner

*Primary Examiner*—Jerry Redman
(74) *Attorney, Agent, or Firm*—Carstens & Cahoon, LLP; Colin P. Cahoon; Christopher P. O'Hagan

(57) ABSTRACT

The present invention provides a control apparatus for automatic sliding doors that can be used with a plurality of door brands and models. The invention includes a control box and an idler pulley mounted to the door header. Both the control box and idler pulley can be mounted on a variety of door models by means of specific header brackets that are configured for each door model. The control box also provides a universal signal interface that can interpret sensor signals from a plurality of door models. A drive belt revolves on the idler pulley and is moved by a motorized pulley controlled by the control box. At least one belt bracket is fastened to the drive belt with a belt clamp, wherein the belt bracket is attached to a sliding door panel. Like the control box and idler pulley, the belt bracket can be used with a variety of door models and is attached to the sliding panel by means of a door bracket that is specific to the door model in question.

8 Claims, 14 Drawing Sheets

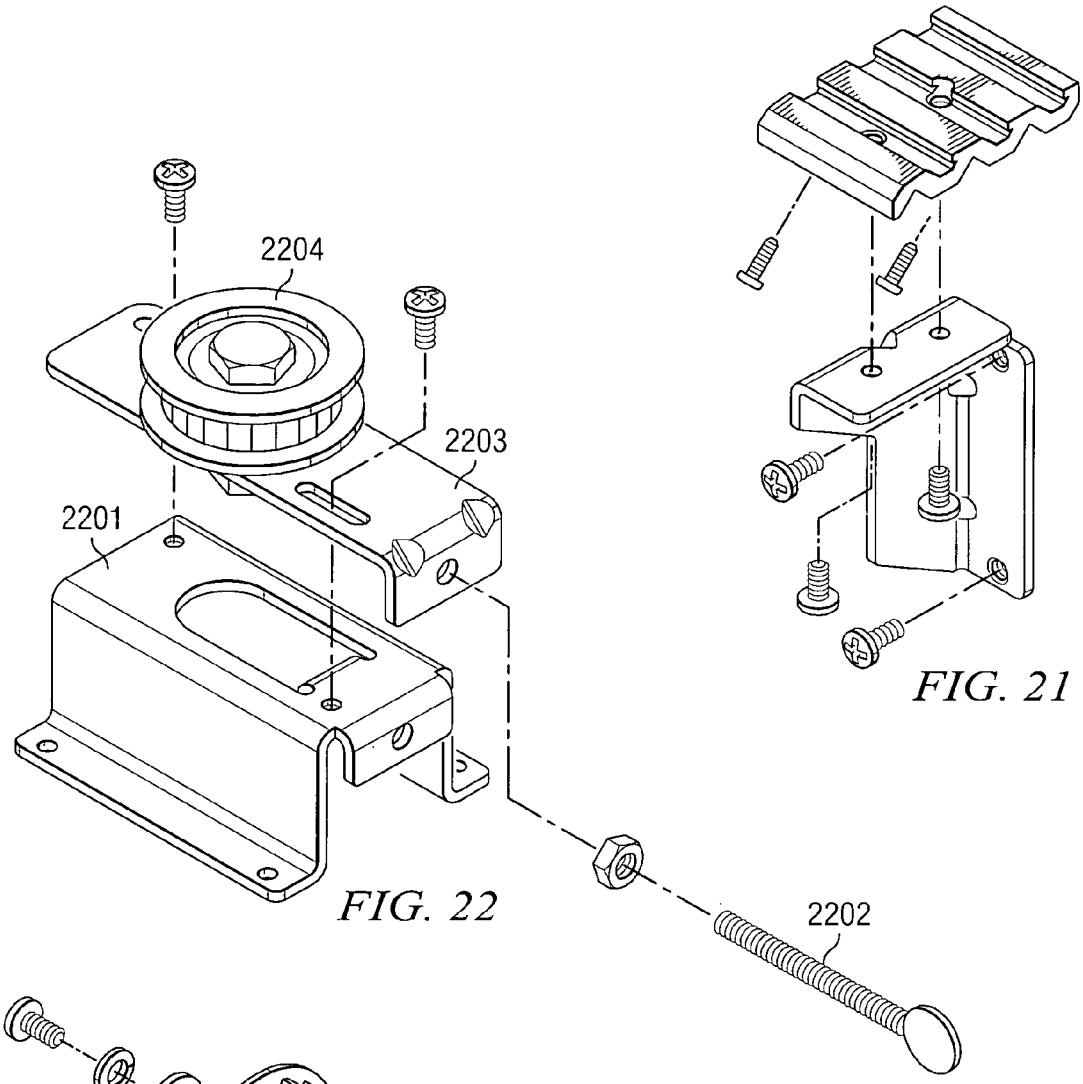
FIG. 21
FIG. 22
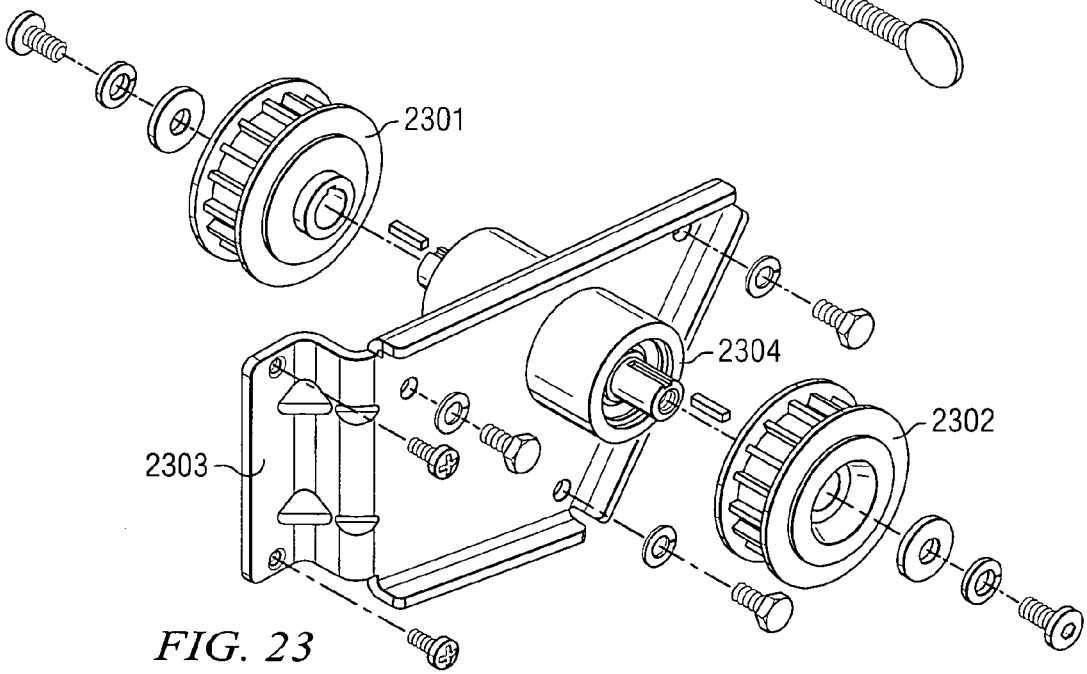
FIG. 23

AUTOMATIC DOOR CONTROL APPARATUS

BACKGROUND OF THE INVENTION

1. Technical Field

The present invention relates generally to automatic pedestrian sliding doors, and more specifically to a control and drive mechanism that can be retrofitted to existing automatic pedestrian doors.

2. Description of Related Art

Automatic pedestrian sliding doors are commonplace in many shopping centers, office buildings, hospitals, airports and the like. Motors and control mechanisms mounted in the doorframes control the movement of the doors, usually in combination with motion sensors or pressure pads in the floor that detect people and objects approaching the doors.

Typically, the motor/control mechanisms are specific to the door brand and model, which reduces user flexibility in upgrading to newer technologies. To update the control mechanism, the customer is required to replace the entire door assembly or the exact replacement part that is defective or malfunctioning. The costs of this all or nothing approach include not only cost of the complete door assembly itself or the location of exact replacement parts (which might no longer be in production) but also remodeling and the necessary inconvenience and disruption to business that goes along with such major renovations.

Therefore, it would be desirable to have an automatic door control mechanism that can be retrofitted to automatic doors already installed and in service, independent of door brand or model and incorporating updated control technology.

SUMMARY OF THE INVENTION

The present invention provides a control apparatus for automatic sliding doors that can be used with a plurality of door brands and models. The invention includes a control box and an idler pulley mounted to the door header. Both the control box and idler pulley can be mounted on a variety of door models by means of specific header brackets that are configured for each door model. The control box also provides a universal signal interface that can interpret sensor signals from a plurality of door models. A drive belt revolves on the idler pulley and is moved by a motorized pulley controlled by the control box. At least one belt bracket is fastened to the drive belt with a belt clamp, wherein the belt bracket is attached to a sliding door panel. Like the control box and idler pulley, the belt bracket can be used with a variety of door models and is attached to the sliding panel by means of a door bracket that is specific to the door model in question.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

FIG. 21 is another example of a door-specific chassis bracket;

FIG. 22 shows the idler assembly in greater detail; and

FIG. 23 shows an alternate drive scheme in which a transfer shaft conducts the drive power to the existing belt and drive mechanism from the original manufacturer.

DETAILED DESCRIPTION

Figure 1:
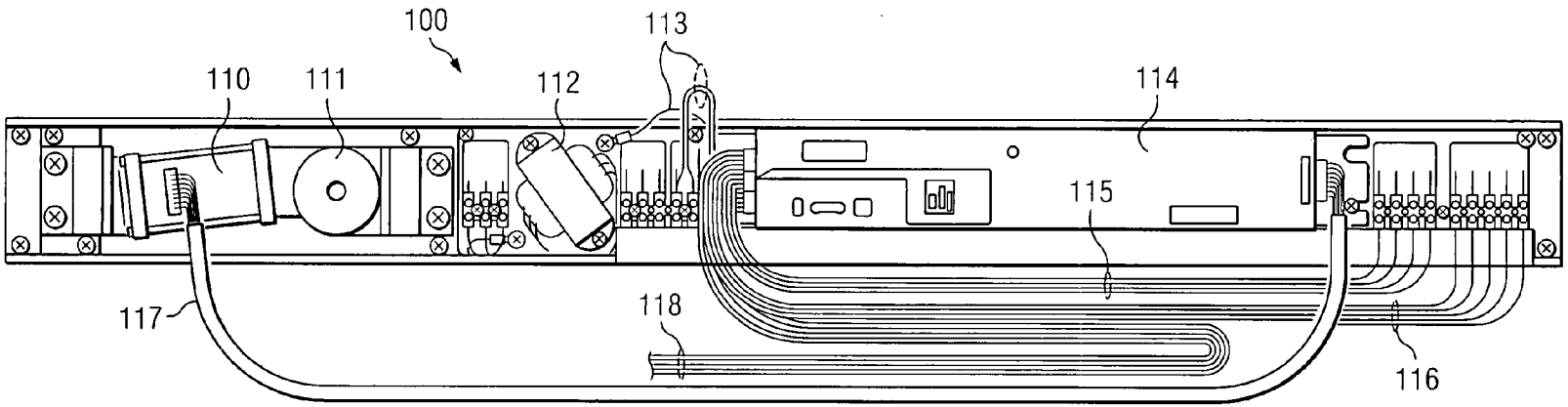
FIG. 1 depicts a motor/control assembly for an automatic sliding door in accordance with the present invention.
Figure 2A:
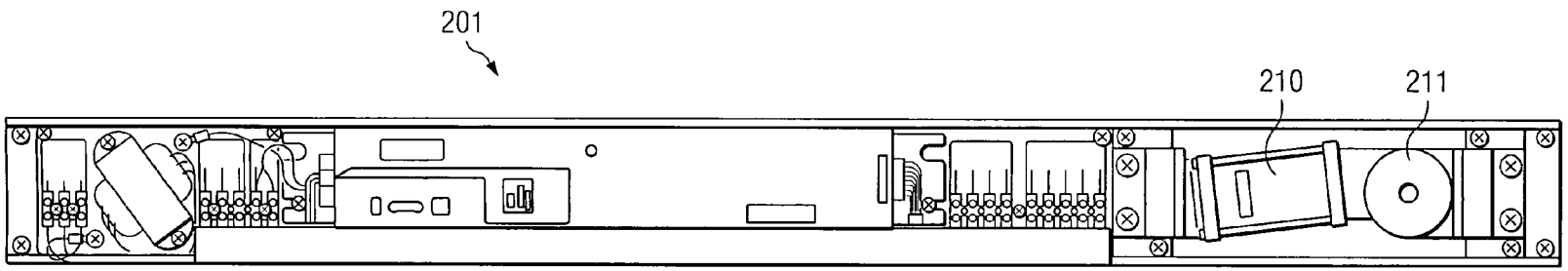
FIG. 2 depicts alternate configurations of the present invention that accommodate different automatic door models.
Figure 2B:
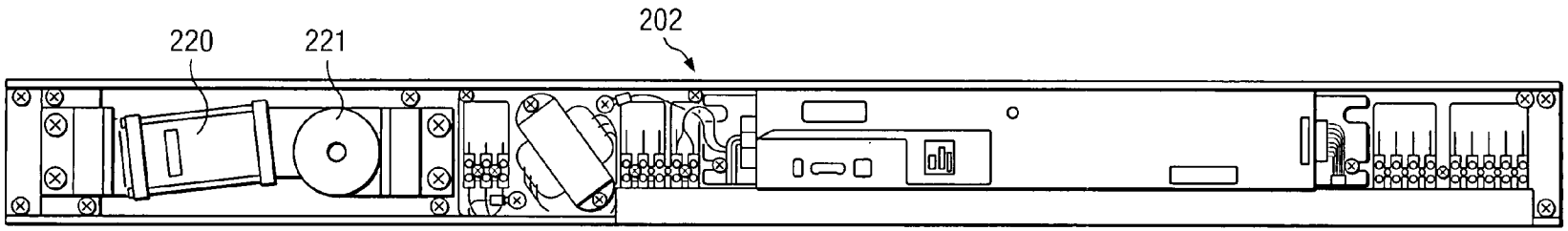
Figure 2D:
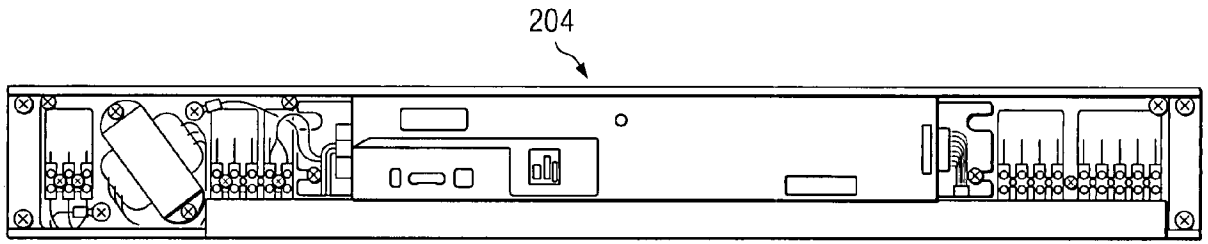
Figure 2C:
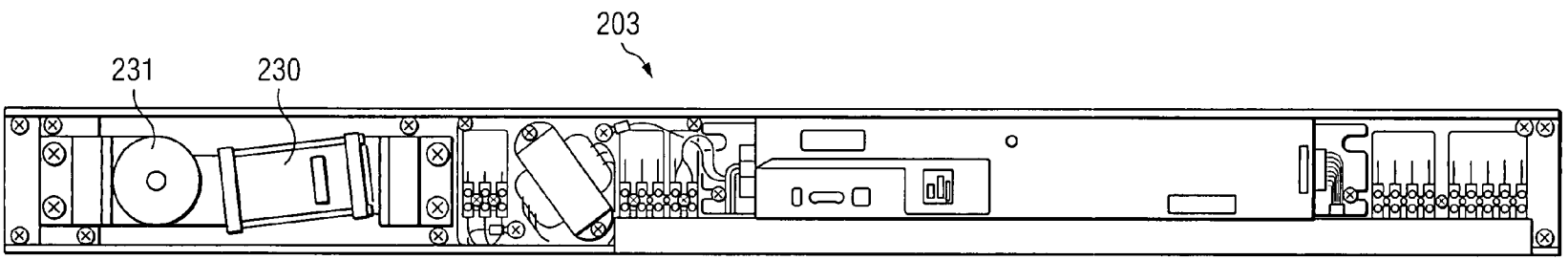

FIG. 1 depicts a motor/control assembly for an automatic sliding door in accordance with the present invention. The motor/control assembly 100 includes a motor 110 that drives a pulley 111, which in turn moves a belt attached to the sliding doors (not shown). An electronic control box 114 controls the operation of the motor 110 and pulley 111 via a motor cable 117.

Sensor input to the control box 114 is provided by sensor cable assembly 115, and an extended input/output (I/O) cable assembly 116 provides the control box 114 with input for special functions, e.g., emergency open. Also pictured in FIG. 1 are unused leads 118 from the extended I/O cable assembly, which are folded over and enclosed in a wire duct. Such unused leads may be common when retrofitting the motor/control assembly 100 to preinstalled doors. The unused leads support functions that are rarely required. Therefore, providing access to these leads via terminal blocks would require additional foot print space on the assembly that would be wasteful from a product point of view.

A transformer 112 and power cable assembly 113 provide power to the control box 114. 12VAC and 24VAC power is provided via terminal blocks for sensors that are external to the product.

FIG. 2 depicts alternate configurations of the present invention that accommodate different automatic door models. The functional components comprising the control assemblies 201-204 depicted in FIG. 2 are essentially the same, but their spatial position relative to each other are different. This variation in component arrangement facilitates compatibility with different door configurations. For example, the motor 210 and pulley 211 on assembly 201 are on the right side, while assemblies 202 and 203 have their motors 220, 230 and pulleys 221, 231, respectively, on the left side.

As a further variation, the motor/pulley combination on assemblies 202 and 203 are reversed. On control assembly 202, the motor 220 is outside of the pulley 221, whereas in control assembly 203, the motor 230 is inside the pulley 231. These more specific motor/pulley arrangements allow even greater flexibility in retrofitting preexisting doors, depending on, e.g., the length of travel of the doors, mounting points on the doors, etc.

As can be seen in FIG. 2, control assembly 204 does not have a motor and pulley. This configuration is suited for automatic doors that require the motor to be positioned in a way that cannot be achieved with the three other configurations depicted 201, 202 and 203. In these cases the motor is mounted separately with its own brackets.

Figure 3:
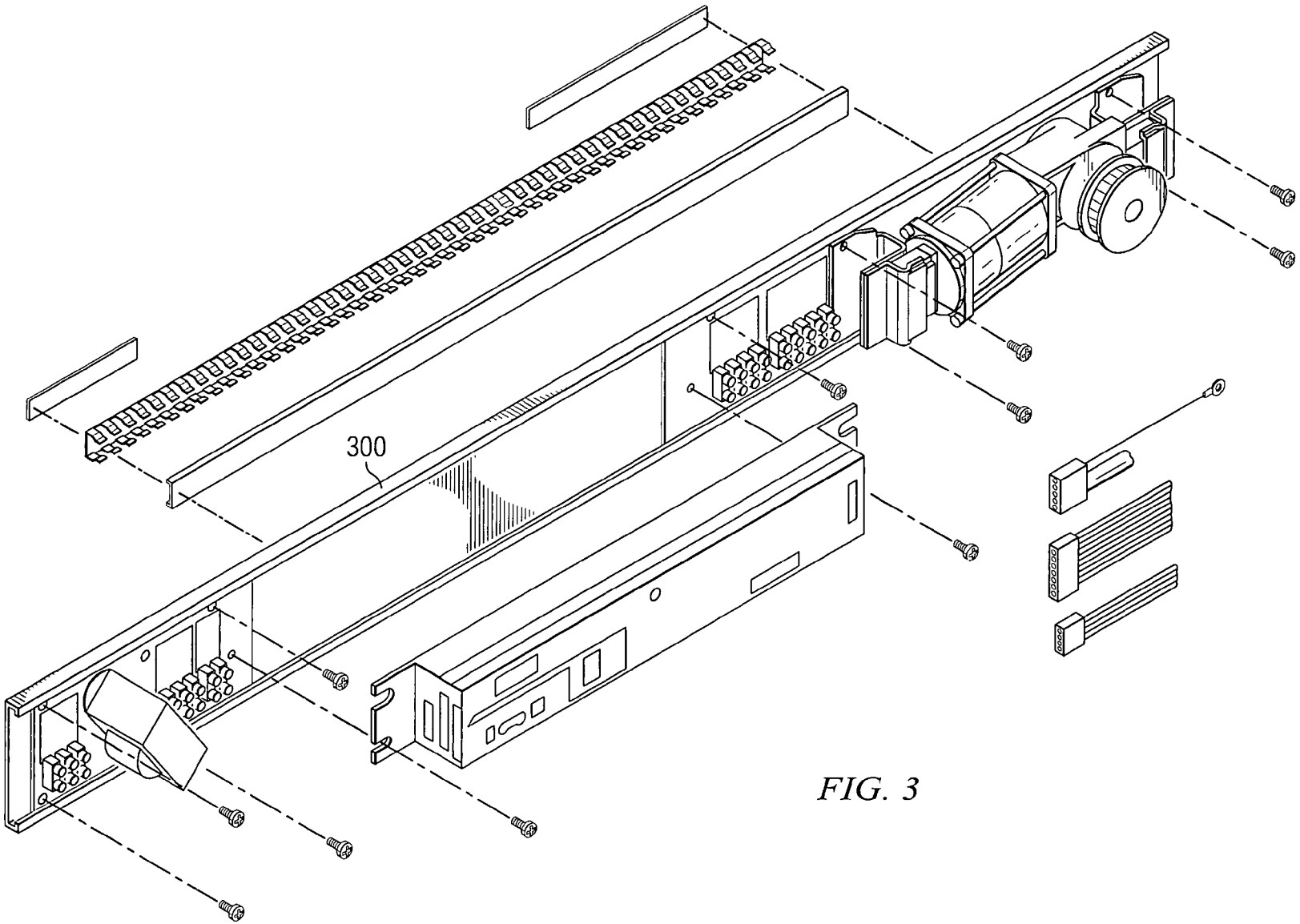
FIG. 3 is an exploded, perspective view of a motor/control assembly.

FIG. 3 is an exploded, perspective view of a motor/control assembly. This exploded view illustrates how the various components of the assembly can be combined into a universally applicable device by mounting them on a single aluminum extrusion 300. The extrusion 300 serves as a chassis for the components and provides the basis for attaching the various mounting brackets.

Figure 4:
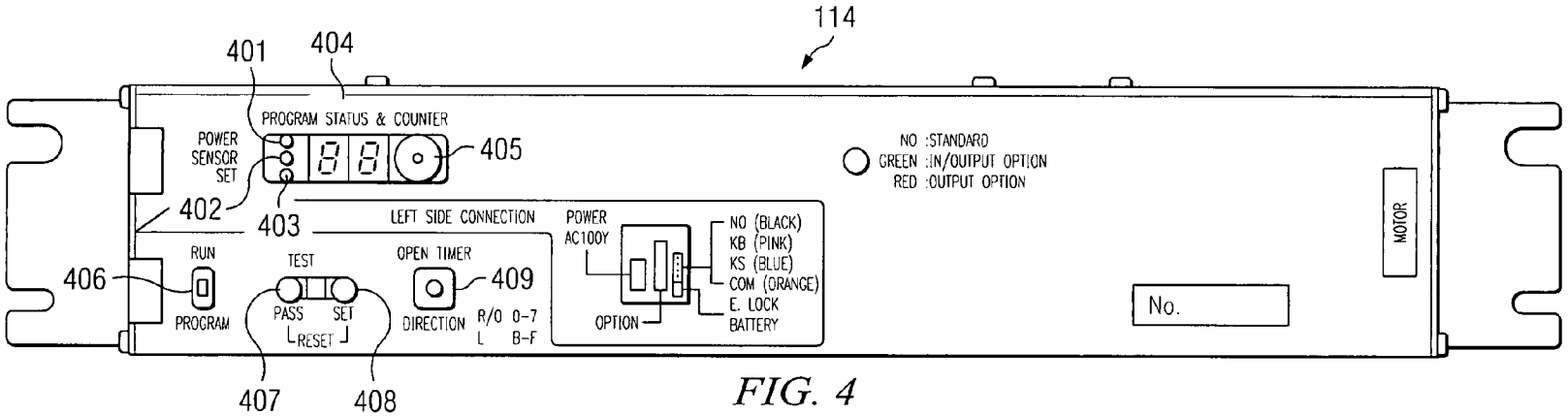
FIG. 4 is a more detailed view of the control box pictured in FIG. 1.

FIG. 4 is a more detailed view of the control box 114 pictured in FIG. 1. This control box 114 may be an off-the-shelf component and provides functionality in accordance with ANSI 156.10-1999. The box has a series of light emitting diode (LED) displays 401-403 on the left side. LED 401 is the power indicator, LED 402 is the sensor indicator and program setting on/off indicator, and LED 403 is the program mode indicator. Next to these LEDs is the counter and program status indicator 404, which monitors the operation of the control box 114.

Located next to the counter/program status indicator 404 is a buzzer 405 that sounds in response to errors in the operation of the door. The buzz patterns comprise combinations of long and short buzzes, similar to Morse code, with each pattern corresponding to a specific type of error. For example, if there is an opening error and the door cannot slide open properly, the buzz pattern might be short, long, short, long, short. Examples of causes for an opening error include a door weight that exceeds operational limits, driving torque that is too weak for the door weight, or an object blocking the door. As another example, a specific buzz pattern might sound if the door runs a longer distance that the memorized door stroke due to, e.g., a loose belt or the doorstopper moving back.

A run/program switch 406 allows the operator to switch between normal operations and a testing/programming mode. When the switch 406 is slid into the Program position, the operator can test the door function by means of a test/pass button 407. If the door operation is satisfactory, the operator pushes the set button 408, and the settings are programmed. The run/program switch 406 is then switched back to the Run position.

The opening timer/direction switch 409 allows the operator to set the direction in which the automatic door will open as well as how long the door will be held open. For example, the door might be set to open left or right if there is only one moving door section, or in the case of two moving doors, the switch 409 can be set for bi-directional opening. The switch 409 also allows the operator to select between different "hold open" times, e.g., 4, 6, or 10 seconds.

Because the various sensors are part of the door, the present invention also provides a universal interface to the signals from these sensors by providing a controller than can respond to the various sensors irrespective of the specific door model.

Figure 5:
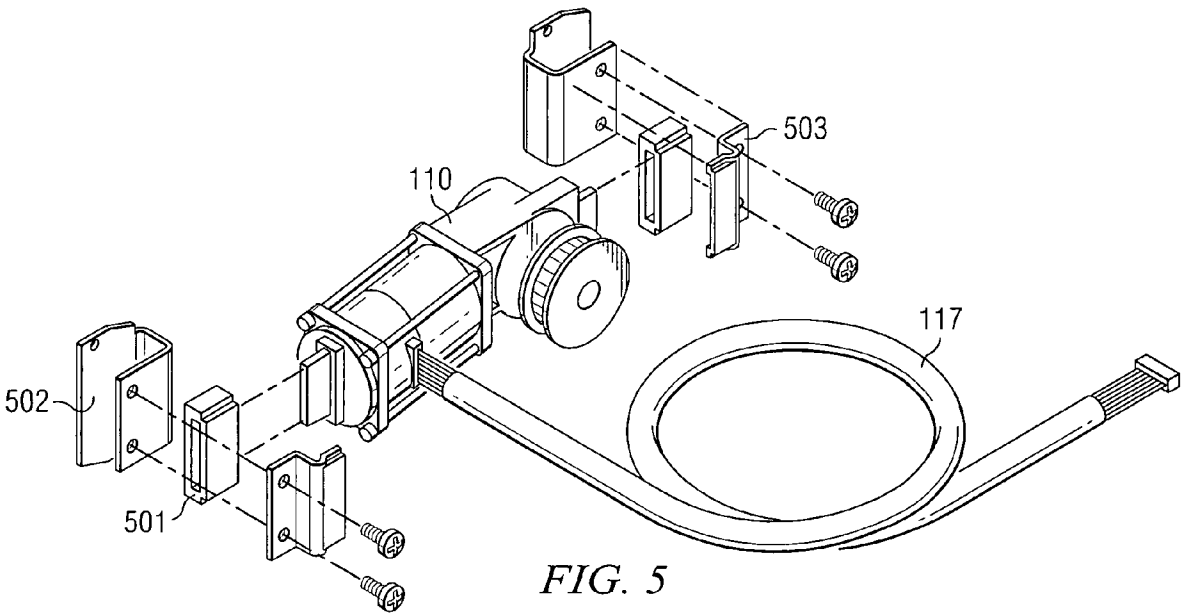
FIG. 5 is an exploded, perspective view of the drive motor and its mounting components.

FIG. 5 is a perspective view of the motor and its mounting components. In the preferred embodiment of the present invention, the motor 110 is a 40 W (1/20 HP) brushless, molded DC motor with an enclosed hypoid gear system. As can be seen is this perspective view, the timing pulley 111 is grooved along its contact surface to allow it to securely engage the belt that moves the sliding door(s). Also depicted is the motor cable 117 by which the control box sends commands to the motor 110 and by which the motor encoder sends signals to the controller.

The motor 110 can move the sliding doors (opening or closing) at speed of 4 inches per second to 29 in/s via 16 adjustable speed steps. The force of the moving doors can range from 40.0 pounds per square foot to 48.5 lb/sf. The gear reduction ratio of the motor 110 is 1:8.2. Encoder resolution uses 30 pulses per revolution and 246 pulses/revolution after gear reduction. The door travels 0.024" per pulse.

The ends of the motor 110 are held between the mounting brackets 502 and mounting clamp 503 by rubber vibration isolation mounts 501. These rubber mounts 501 absorb vibrations from the motor, providing quieter operation than would otherwise be the case without them.

Figure 6:
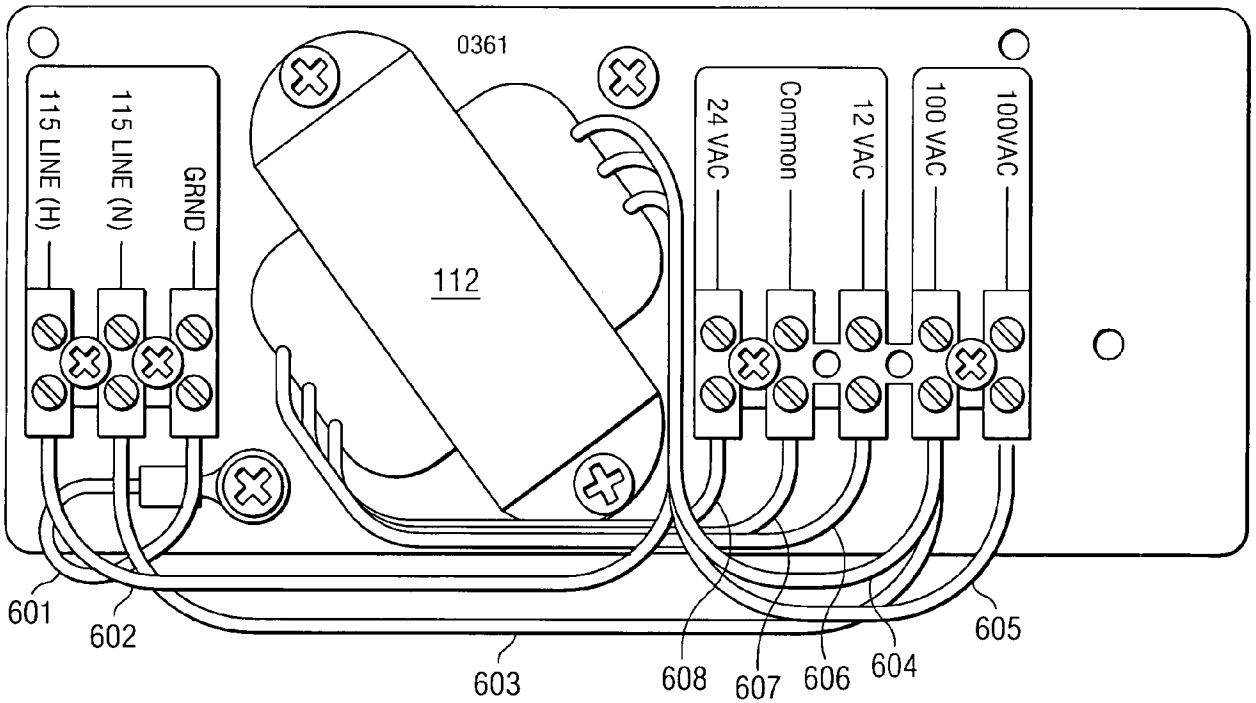
FIG. 6 depicts the transformer and power terminal block assembly in greater detail.

FIG. 6 depicts the transformer 112 and power terminal block assembly in greater detail. The assembly to the left of the transformer 112 comprises three wires 601-603. The first two 602, 603 are 115 lines, with one, 602, leading directly to the transformer 112, and the second 115 line leading to a 100 VAC terminal where it continues to the transformer 112 via wire 604. The third wire 601 in this left side assembly is the ground wire.

The assembly to the right of the transformer 112 comprises most of the leads to and from the transformer. At the far end, two 100 VAC lines 604, 605 lead into the transformer 112. A 12 VAC line 606, a Common line 607, and a 24 VAC line 608 lead back from the transformer 112.

Figure 7:
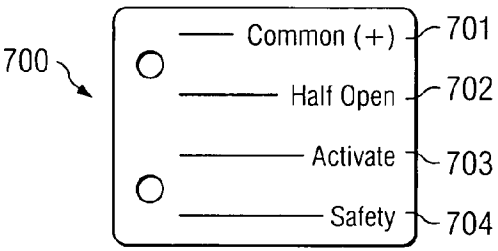
FIG. 7 shows the terminal block label for the sensor cable assembly.

FIG. 7 shows the terminal block label for the sensor cable assembly. The label 700 is presented here as a proxy for the signal terminals. The first terminal in the assembly is the common 701, followed by the half open terminal 702, which is used when the automatic door is to be partially opened. This is typically done for extreme hot or cold weather. In such situations, the door is opened to a predetermined percentage of its full open stroke in order to conserve heating/cooling energy. This percentage is one of the definable parameters of the controller. For a bi-part door both doors are always operated in tandem; this is a safety requirement and is a practical reality as the doors are mechanically slaved to each other. The next terminal 703 relates to activation of normal automatic door function by, e.g., a motion sensor or pressure pad in the floor, and the safety terminal 704 relates to activation of the safety features that override normal door operation in response to a variety of safety signals or conditions such as mechanical feedback on the doors themselves, e.g., an object impeding door closing or a person or object blocking a safety sensor in the door path, or a signal from a side screen sensor, etc.

Figure 8:
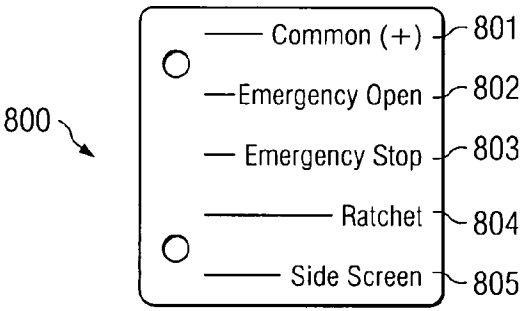
FIG. 8 shows the terminal block label for the extended I/O cable assembly.

FIG. 8 shows the terminal block label for the extended I/O cable assembly. Again, the label 800 is presented as a proxy for the signal terminals. As with terminal block 700, the first terminal for the extended I/O assembly is the common 801. The next two terminals are the emergency open terminal 802 and emergency stop terminal 803. The emergency open function would be activated in response to, e.g., a signal from a fire alarm. The emergency stop function generally comes from the breakout sensors; if the door is manually "broken out" (pushed open for an emergency exit) this condition is detected and any further drive to the door motor is stopped.

The ratchet function represented by terminal 804 relates to special activation of the door by means other than the normal motion or pressure sensors. "Ratchet" specifically means that a signal will cause the door to change open/closed states and stay that way until another ratchet signal is received, e.g., if the door is closed a ratchet signal will cause it to open and stay open indefinitely. When a subsequent ratchet signal is received the door will close and stay closed indefinitely. An example of a ratchet activation device is the handicap access buttons found on many automatic doors, which open the doors when the buttons are depressed. Similar ratchet activation buttons are used in hospitals to facilitate easier access of gurneys.

Figure 9:
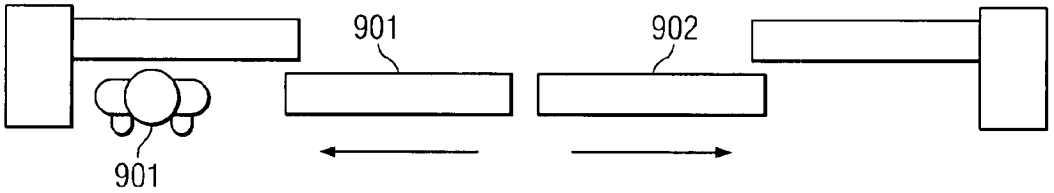
FIG. 9 shows a person blocking the path of opening doors in the "side screen" area.

The side screen terminal 805 relates to sensors that detect objects or people blocking the path of the opening doors, as illustrated in FIG. 9. As the automatic doors 901, 902 open in response to an approaching person, the side screen sensor detects another person or object 910 standing the path of door 901. In response, safety mechanisms will stop the doors 901, 902 from activating. However, once the door open sequence has been initiated the side screen signal is ignored, otherwise it would see the door itself moving into the space and never be able to open.

Figure 10:
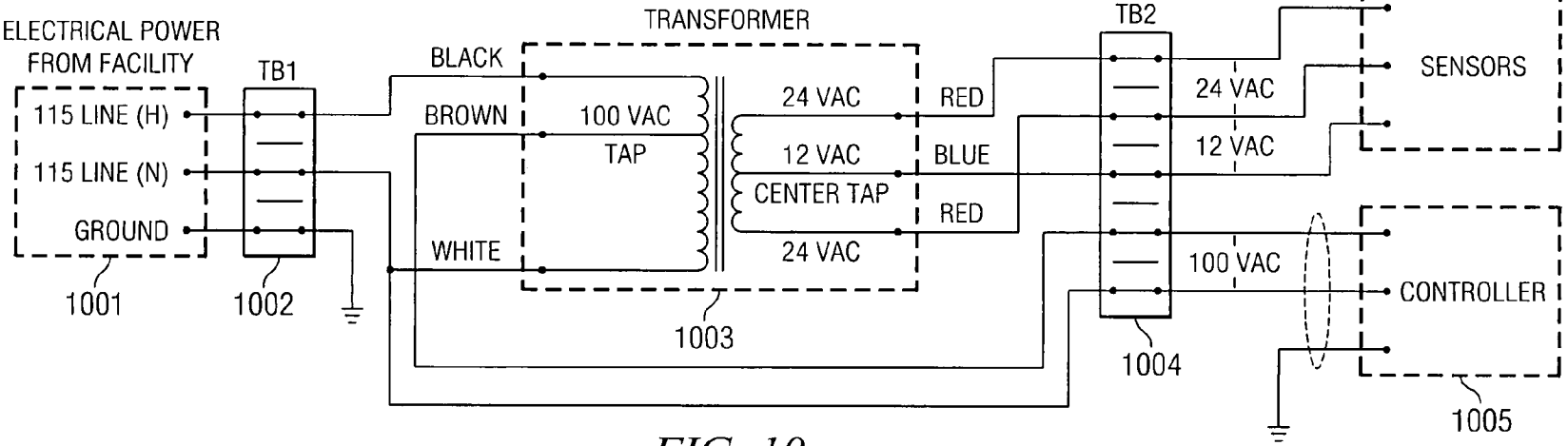
FIG. 10 is an electrical power schematic of the control system of the present invention.

FIG. 10 is an electrical power schematic of the control system of the present invention. Electrical power from the facility 1001 is sent to the first terminal block 1002, which has three positions: two 115 VAC terminals and a ground terminal. The transformer 1003 received the 115 VAC input from the first terminal block 1002 and produces 100 VAC, 24 VAC, and 12 VAC output to the second terminal block 1004. The 100 VAC leads go to the controller 1005, and the 24 VAC and 12 VAC leads power the sensors 1006.

Figure 11:
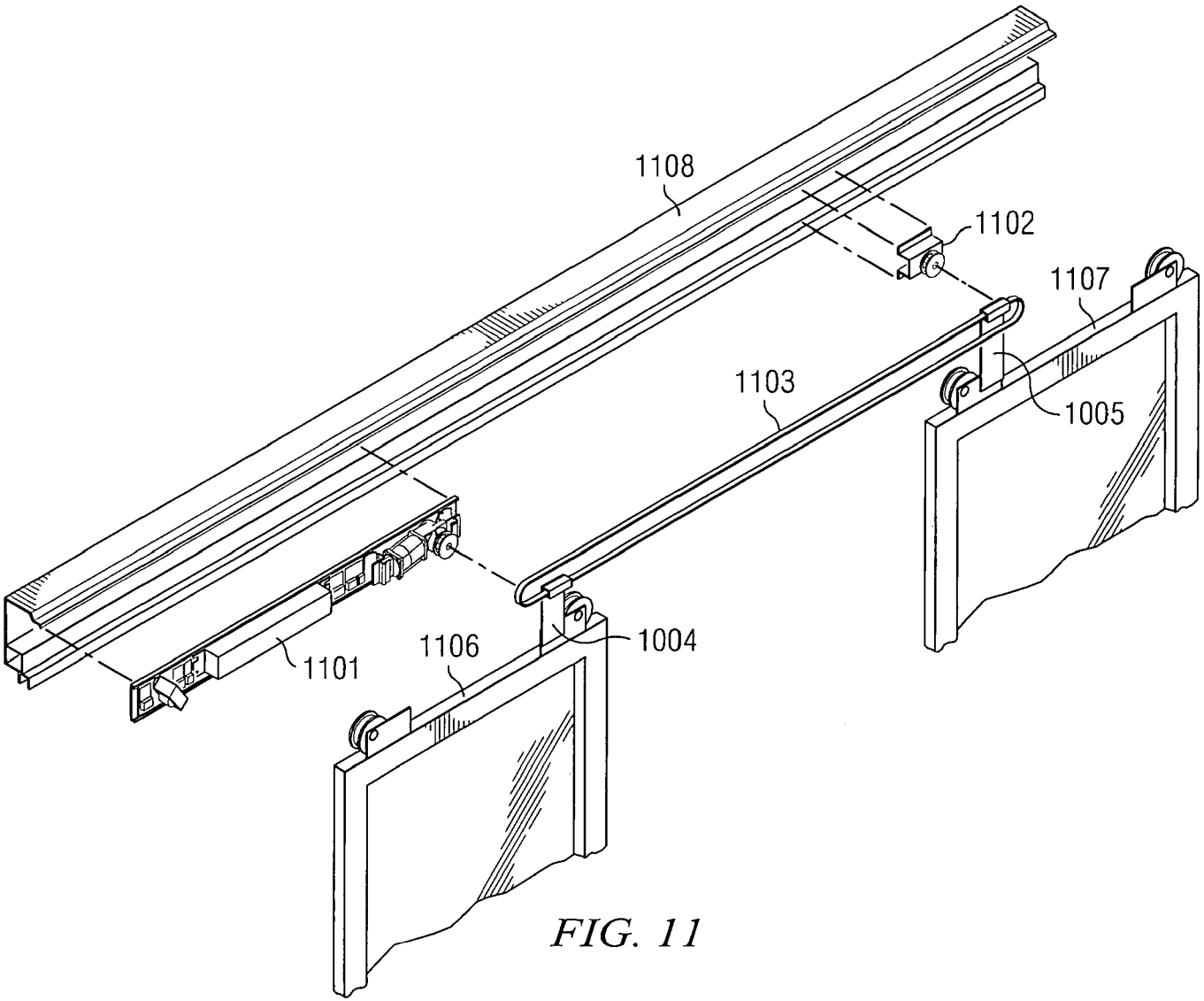
FIG. 11 is an exploded, perspective view of the motor/control assembly installed in an automatic door.

FIG. 11 is an exploded, perspective view of the motor/control assembly installed in an automatic door. The control assembly 1101 is mounted in the overhead frame 1108 of the door (always referred to as a "header" in the automatic door industry), as is an opposing contact pulley 1102. The second pulley 1102 (belt idler assembly) is passive and its distance from the pulley on the control assembly 1101 defines the distance of movement for the sliding door panels 1106, 1107.

Force from the motorized pulley on the control assembly 1101 is transmitted to the sliding doors 1106, 1107 via the drive medium (belt) 1103. The drive belt 1103 that acts as the medium of power transfer can have many embodiments, e.g., 8 mm pitch, 10 mm wide HTD-type toothed drive belt or other type of belt. Alternatively, the drive medium can be a cable, roller chain, or any other drive type or hybrid combination. For purposes of the present invention, the specific drive medium used (belt, chain, cable, etc.) is not important, as long as it can transfer power from the motor to the sliding door panels.

Attached to each sliding door are fixed brackets 1104, 1105, which in turn are attached to the belt 1103. As can be seen in FIG. 11, one bracket 1104 attaches to the lower straight section of the belt 1103, while the other bracket 1105 is attached to the upper section. This arrangement allows the sliding doors 1106, 1107 to move in opposite directions as the belt 1103 rotates clockwise or counterclockwise.

Figure 12A:
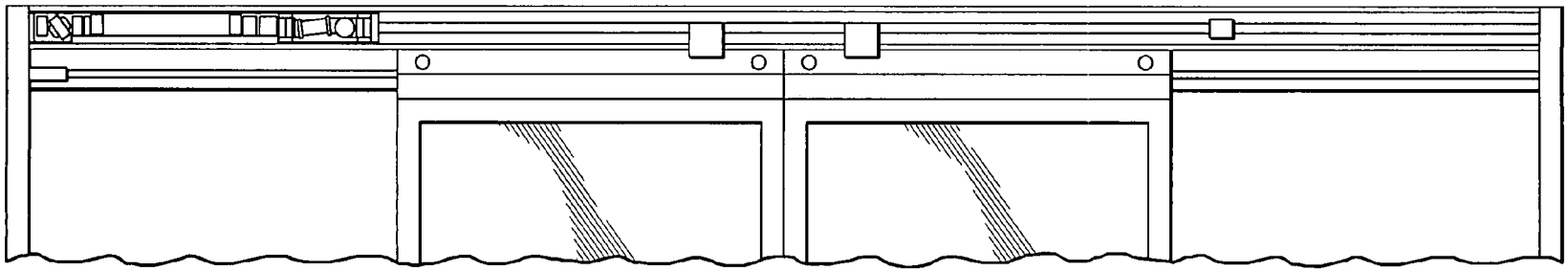
FIG. 12A is a front plan view of the automatic door depicted in FIG. 11 in the closed position.
Figure 12B:
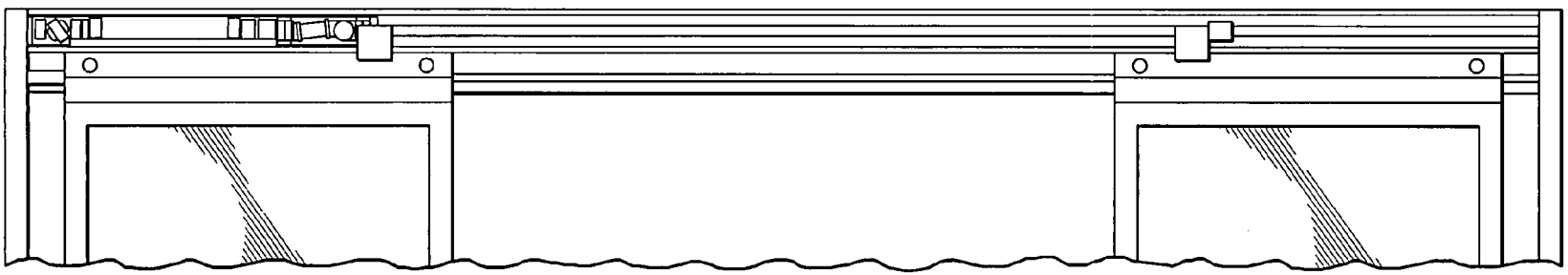
FIG. 12B is a front plan view of the automatic door depicted in FIG. 11 in the open position.

FIGS. 12A and 12B are front plan views of the automatic door depicted in FIG. 11. FIG. 12A shows the automatic doors in the closed position, and FIG. 12B shows the open position.

Figure 13A:
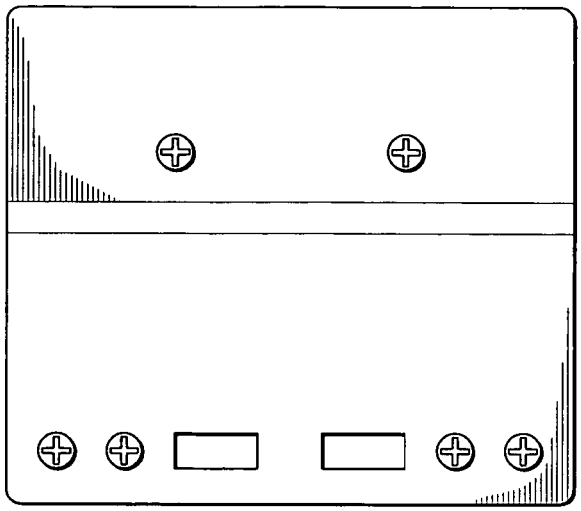
FIGS. 13A and 13B are front plan and side views, respectively of the upper belt bracket used to secure the moving door elements to the drive belt, as depicted in FIG. 11.
Figure 13B:
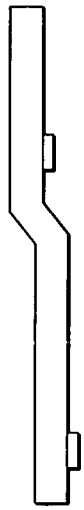

FIGS. 13A and 13B are front plan and side views, respectively of the upper belt bracket used to secure the moving door elements to the drive belt, as depicted in FIG. 10.

Figure 14A:
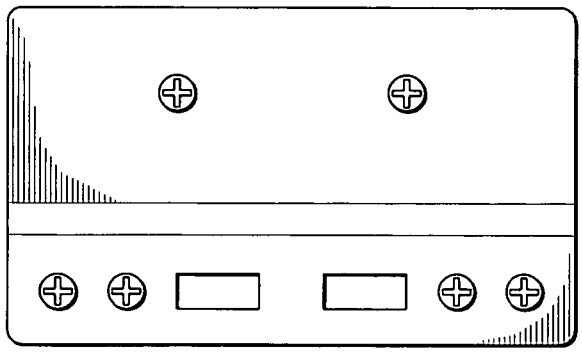
FIGS. 14A and 14B are front plan and side views, respectively of the lower belt bracket used to secure the moving door elements to the drive belt, as depicted in FIG. 11.
Figure 14B:
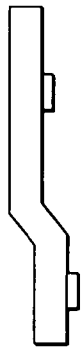

FIGS. 14A and 14B are front plan and side views, respectively of the lower belt bracket used to secure the moving door elements to the drive belt, as depicted in FIG. 10.

Note that the upper and lower belt brackets depicted in FIGS. 13 and 14 are incomplete in and of themselves. The upper and lower belt brackets are attached to the belt by the use of a belt clamp, described in more detail below. This is an important feature contributing to the universality of the invention. The belt brackets and belt clamp are used in almost all types of doors. The belt brackets are attached in turn to door brackets, which are specific to each type/brand of door. The interface between the universal portion of the invention and the brand-specific sliding panels of the door occurs between the belt brackets and the door brackets.

Figure 15:
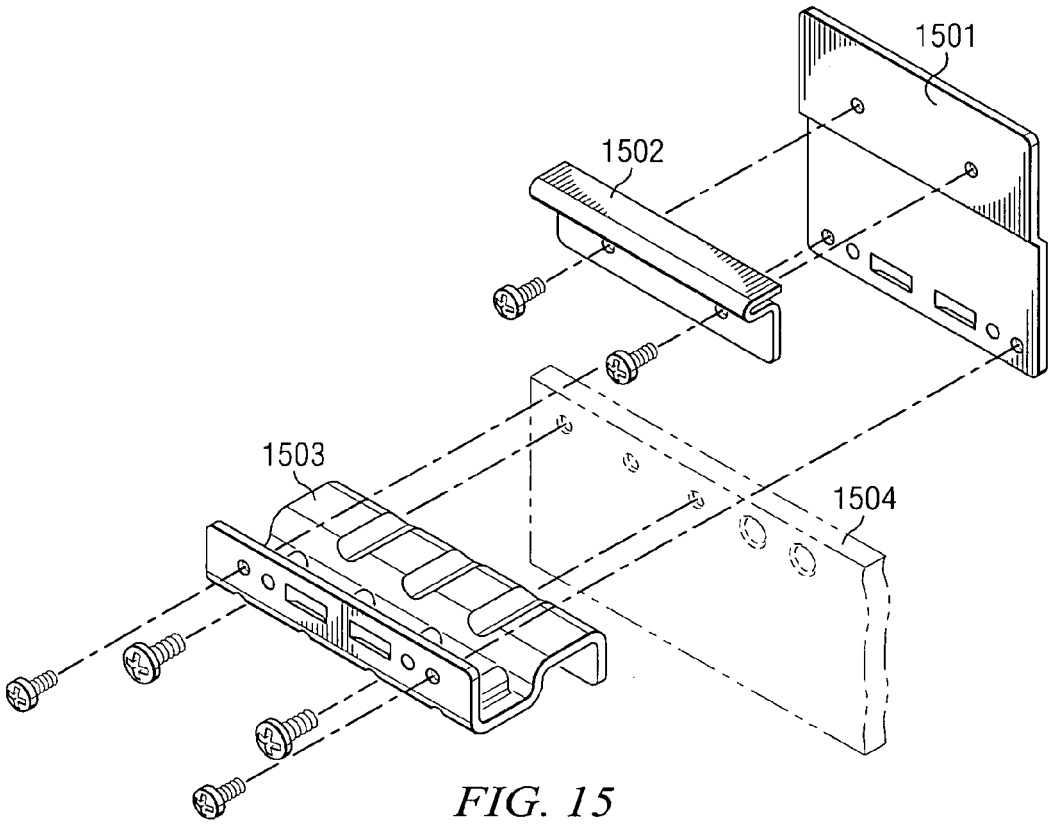
FIG. 15 is an exploded perspective view of a door model-specific upper bracket mount assembly.

FIG. 15 is an exploded perspective view of a brand-specific upper bracket mount assembly. This example illustrates the assembly for a Keane Monroe 7000 door model. As explained above, the upper belt bracket 1501 and belt clamp 1502 are universal components that can be used on any door model. The belt (not shown) is held by the curved upper section of the belt clamp 1502, which is then fastened to the belt bracket 1501. Then belt bracket 1501 is in turn fastened to the brand specific door bracket 1503, which is attached to the door 1504.

Figure 16:
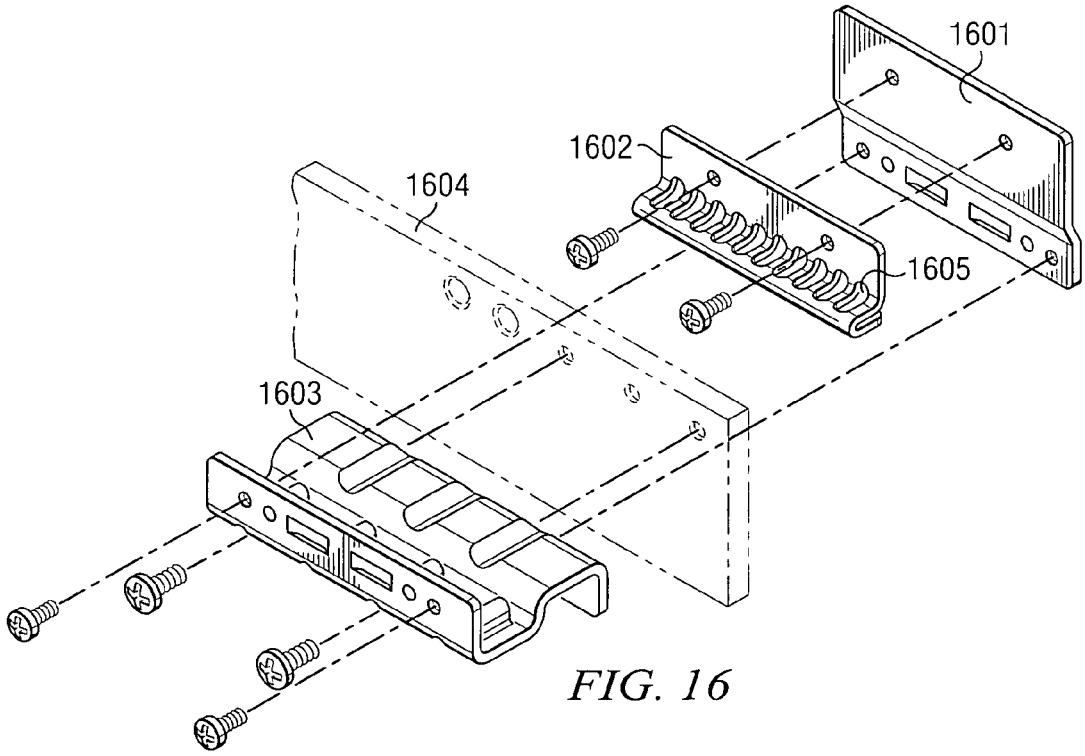
FIG. 16 is an exploded perspective view of the lower bracket mount assembly for the example door model depicted in FIG. 15.

FIG. 16 shows the lower bracket mount assembly for the Keane Monroe 7000 door model. Because the belt clamp 1602 in this facing upward for the lower bracket assembly, this view allows one to see the spaces 1605 in the belt clamp 1602 that accommodate "teeth" in the door belt (not shown). The belt clamp 1602 is mounted to the lower belt bracket 1601, securing the belt in place. The belt bracket 1601 is then mounted to the door bracket 1603, which in turn is mounted on the door 1604.

Figure 17:
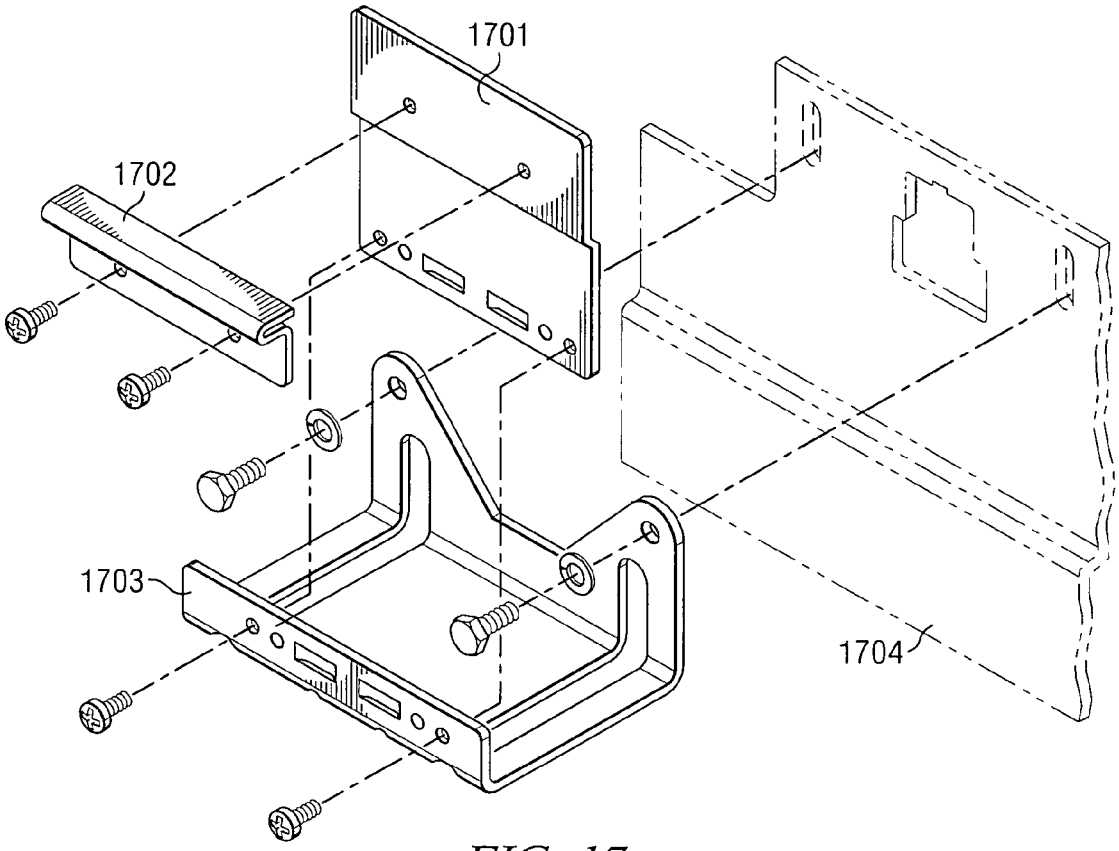
FIG. 17 is another example of a door model-specific upper bracket mount assembly.

FIG. 17 is another example of a brand-specific upper bracket mount assembly. This example assembly is for the Besam Unislide door model. Note that the upper belt bracket 1701 and belt clamp 1702 are identical to those in FIG. 15. As stated above, these are universal components of the invention and remain the same for all door models to which the invention is applied. The door bracket 1703 is specific to the particular mounting structure of the door 1704.

Figure 18:
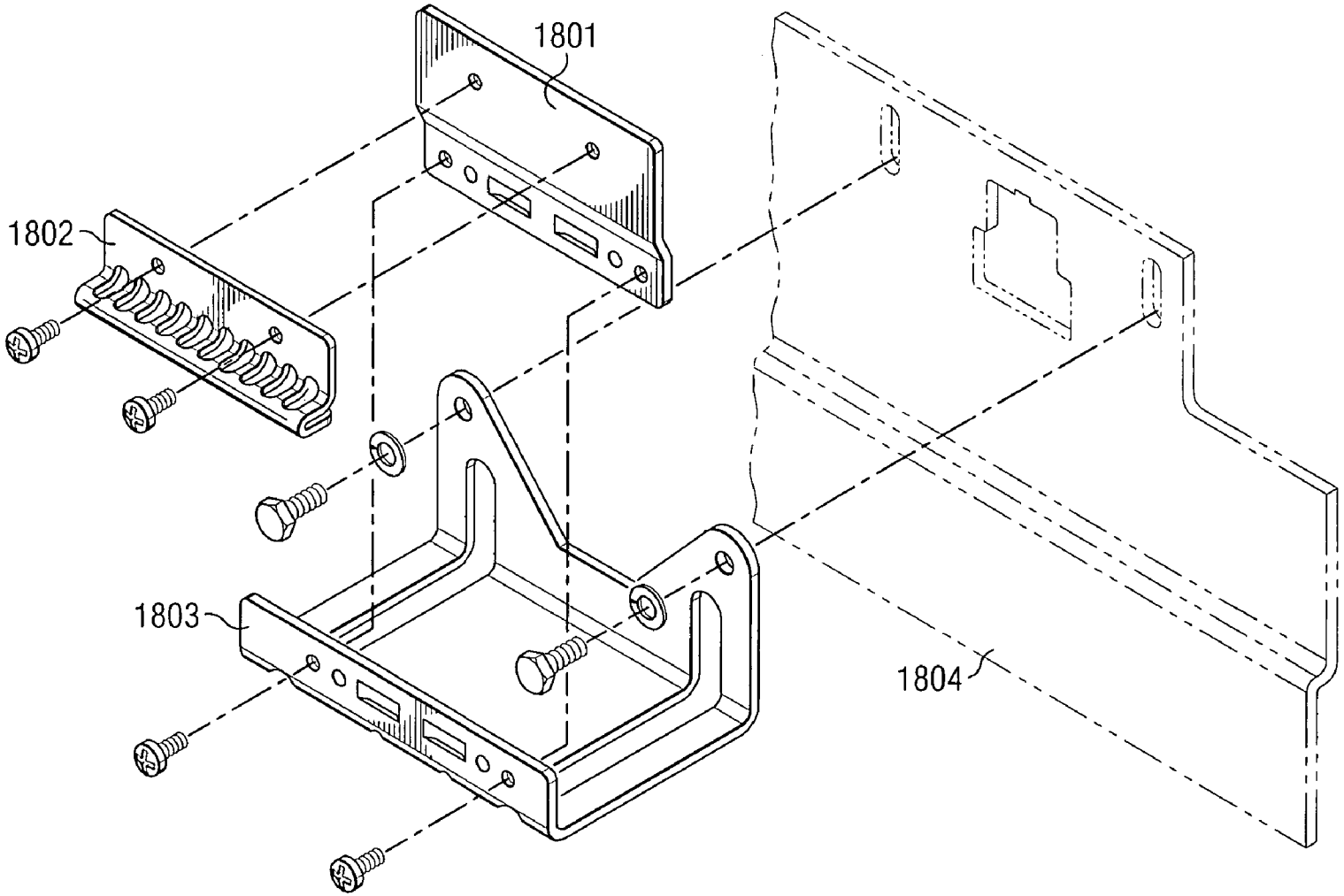
FIG. 18 is the lower bracket mount assembly for the example door model depicted in FIG. 17.

FIG. 18 is the lower bracket mount assembly for the example depicted in FIG. 17. Again, the lower bracket 1801 and belt clamp 1802 are universal and identical to those in FIG. 16, but the door bracket 1803 is specific to the door 1804.

Figure 19:
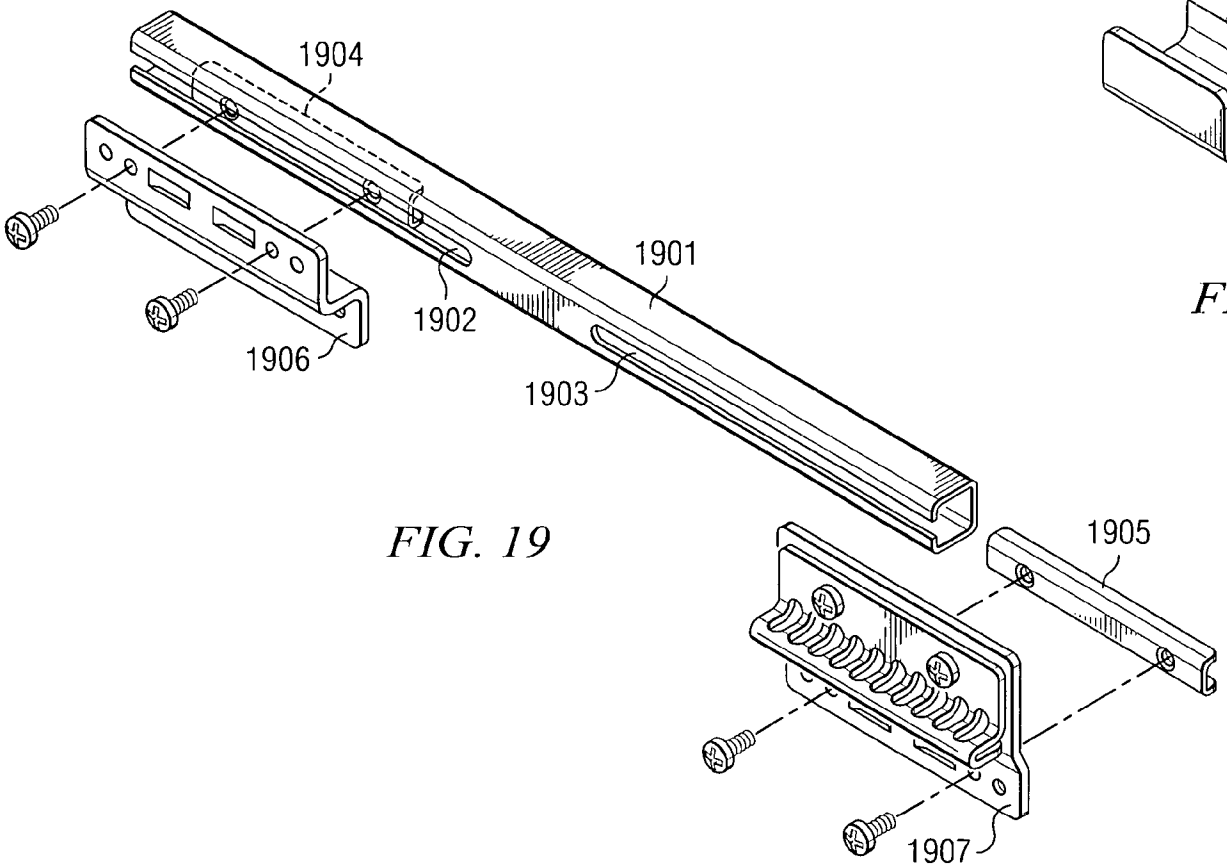
FIG. 19 is an exploded perspective view of universal extension bar kit for mounting brackets.

FIG. 19 is an exploded perspective view of universal extension bar kit for mounting brackets. For several door models, a small amount of offset space is required between the door bracket and the belt bracket. The extension bar 1901 provides this offset. The bar 1901 has slots 1902, 1903 accommodating sliding rails 1904, 1905. The lower bracket 1906 and upper bracket 1907 are then mounted to the rails 1904, 1905, respectively, allowing them to be adjusted inward or outward as required by the specific application. The bar extension kit provides another universal element that can be adapted to the specific bracket space requirements of multiple door models.

The concept of door-specific mounting brackets is also applied to the motor/control assembly and idler assembly, which are both attached to the door header. Similar to the belt brackets, the goal here is to maximize the universal portion of the design. In this case the interface between door-specific components and universal components occurs between the door-specific header bracket(s) and the two primary assemblies: the controller/motor assembly and the idler assembly. A single type of header bracket was developed for each type of door. In some cases a right hand and left hand version of the bracket are required. In a few cases the bracket may be applied to multiple door types.

Figure 20:
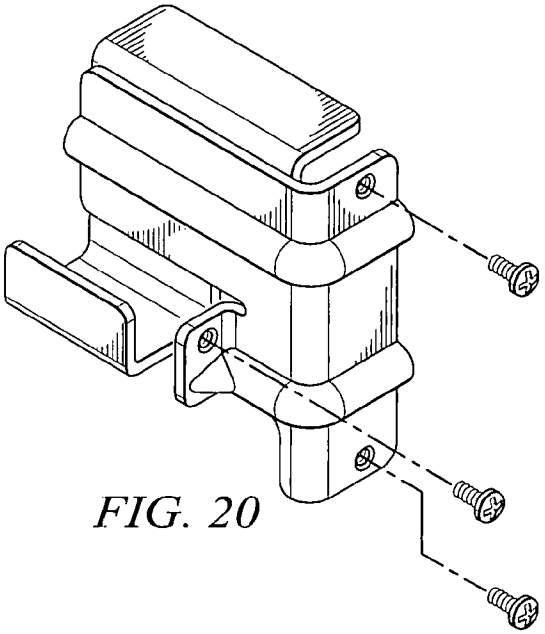
FIG. 20 shows an example of a door-specific chassis bracket.

FIGS. 20 and 21 illustrate door-specific chassis brackets that can be applied to the present invention. As described above, specific configurations of motor/control components can be mounted onto a universal chassis. As with the belt brackets and clamps, this universal motor/control chassis can be mounted to a variety of door-specific mounting brackets, such as those depicted in FIGS. 20 and 21.

FIG. 22 shows the idler assembly in greater detail. As depicted in FIG. 11, the idler assembly provides an opposing contact for the motor on the control assembly to move the drive belt. The idler assembly is mounted onto the door header by means of a door-specific header bracket 2201. In this example, the idler header bracket 2201 also includes an idler slide 2203 on which the contact pulley 2204 is mounted. The slide 2203 is used to adjust the position of the contact pulley 2204 via a thumbscrew 2202, allowing for the fine-tuning of tension on the drive belt.

FIG. 23 shows an alternate drive scheme in which a transfer shaft conducts the drive power to the existing belt and drive mechanism from the original manufacturer. The idler assembly is designed for use with "I Beam" style door headers, which do not allow both the motor/control assembly and the idler assemble to be mounted on the same side. Therefore, the motor/control assembly is mounted on one side and transfers torque to a first contact pulley 2301 on the idler assembly. A transfer shaft 2304 transmits torque from the first contact pulley 2301 through an opening in the header bracket 2303 to a second pulley 2302 on the opposite side, where the conveyer belt and belt brackets are located to move the door panels.

Following the design approach described above, the present invention provides a largely universal product which is adapted to a variety of door types by developing just two door specific components: the door brackets and header brackets. This design allows for the upgrading and retrofitting of in-service doors without the need upgrade or replace the entire door system or to hunt down brand-specific replacement parts that may no longer be in production.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A control apparatus for automatic sliding doors, wherein the control apparatus may be used with a plurality of door brands and models, the control apparatus comprising:

a chassis mounted to a door header;

a control box mounted on said chassis, the control box includes a sensor cable assembly and an input/output cable assembly and provides a universal signal interface with means for interpreting sensor signals from a plurality of automatic door models;

a motorized pulley mounted on said chassis, wherein the motorized pulley is controlled by said control box;

an idler pulley mounted to the door header;

a drive medium that revolves on said idler pulley and is moved by said motorized pulley;

at least one drive medium bracket that is fastened to the drive medium with a clamp, wherein the bracket is attached to a sliding door; and said chassis includes a mounting means which mounts said control box and motorized pulley in different spatial configurations relative to each other, and the control apparatus is retrofitted to existing automatic doors in service, independent of the make and model of said doors.

2. The apparatus according to claim 1, further comprising:

a second drive medium bracket attached to a second door and fastened to said drive medium by a second clamp, wherein the second bracket moves in the opposite direction of the first bracket when the drive medium revolves around the pulleys.

3. The apparatus according to claim 1, wherein the control box can be mounted to a plurality of door models by means of header brackets that are specifically configured for each door model.

4. The apparatus according to claim 1, wherein the idler pulley can be mounted to a plurality of door models by means of header brackets that are specifically configured for each door model.

5. The apparatus according to claim 1, wherein the drive medium bracket can be mounted to a plurality of door models by means of door brackets that are specifically configured for each door model.

6. The apparatus according to claim 1, wherein the drive medium is a belt.

7. The apparatus according to claim 1, wherein the drive medium is a cable.

8. The apparatus according to claim 1, wherein the drive medium is a roller chain.

* * * * *